US006924597B2

(12) United States Patent
Yoshida et al.

(10) Patent No.: US 6,924,597 B2
(45) Date of Patent: Aug. 2, 2005

(54) PLASMA DISPLAY PANEL

(75) Inventors: Kenji Yoshida, Kawasaki (JP); Masayuki Shibata, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 144 days.

(21) Appl. No.: 10/370,524

(22) Filed: Feb. 24, 2003

(65) Prior Publication Data

US 2003/0214235 A1 Nov. 20, 2003

(30) Foreign Application Priority Data

May 17, 2002 (JP) ..... 2002-142689

(51) Int. Cl.[7] ..... H01J 11/00

(52) U.S. Cl. ..... 313/582; 345/60

(58) Field of Search ..... 313/582, 584, 313/585; 345/60; 315/169.4

(56) References Cited

U.S. PATENT DOCUMENTS 6,538,380 B1 * 3/2003 Kanagu et al. ..... 313/582
2001/0040435 A1 11/2001 Park et al.

FOREIGN PATENT DOCUMENTS

| | | |
|---|---|---|
| EP | 1 017 081 A2 | 7/2000 |
| JP | 5-6147 | 1/1993 |
| WO | WO 01/80276 A1 | 10/2001 |

* cited by examiner

*Primary Examiner*—Vip Patel
*Assistant Examiner*—Glenn Zimmerman
(74) *Attorney, Agent, or Firm*—Staas & Halsey LLP.

(57) ABSTRACT

A plasma display panel is provided in which an operational quality is prevented from being deteriorated by resonance of a substrate. The plasma display panel includes a partition for dividing a discharge gas space defined by a pair of substrates and a sealing material in accordance with a cell arrangement of a display screen. There is a void space between the upper surface of the end portion of the partition and the surface of the opposed substrate, the surfaces contacting each other. The natural frequency of the portion from the inner edge of the void space to the inner edge of the sealing material is raised above audio frequency region of a human.

10 Claims, 4 Drawing Sheets

PLASMA DISPLAY PANEL

BACKGROUND OF THE INVENTION

1. Field of the Invention

The present invention relates to a plasma display panel (PDP) and is useful for reducing acoustic noise in operation.

A display device utilizing a plasma display panel is becoming commonplace as a large screen television set. As such a display device is used widely at home, it has been requested to reduce a slight noise in operation.

2. Description of the Prior Art

A surface discharge type PDP for a color display includes a partition for preventing discharge interference between neighboring cells. There are arrangement patterns of the partition including a stripe pattern that divides a display area into columns of a matrix display and a mesh pattern that divides a display area into cells. When the stripe pattern is adopted, a plurality of partitions having a band-like shape in a plan view is arranged in the display area. When the mesh pattern is adopted, one partition (a so-called box rib) that defines each cell individually in a plan view is arranged in the display area. The partition has the height of 150–200 microns and defines a gap size between the substrates in the display area.

In general, a partition is made of a low melting point glass which is burned, and is formed in the following process. (A) Low melting point glass paste is applied to a glass substrate at a uniform thickness and is dried. (B) On the dried paste layer, a mask of a pattern corresponding to the partition is formed by a photolithography process. (C) Portions of the paste layer that are not masked are removed by a sand blast method in which a cutting material is blown. (D) After removing the mask, the patterned paste layer is burned.

In the process of forming a partition, some variation of height of the partition is inevitable. Especially, when the paste layer is patterned by the sand blast method and is burned as explained above, the sand blast causes a side cut, i.e., cutting under the mask in the sand blast process, so that the edge portion of the partition may be higher than other portions in a plan view in the subsequent burning process. More specifically, when a design value of the height of the partition is 140 microns, the edge portion becomes higher than other portions by approximately 30 microns. This phenomenon is called a "raise", and the reason of the "raise" is considered to be uneven of thermal contraction stress. The "raise" phenomenon causes incomplete contact between the substrates in a PDP manufacturing process in which one substrate having a partition is placed on the other substrate. In the major portion of the partition forming area, the upper surface of the partition contacts intimately the surface of the opposed substrate. However, at the vicinity of the "raised" position of the partition forming area, only the raised edge portion of the partition contacts the surface of the opposed substrate. As a result, the substrate is curved microscopically, and a void space is generated between the upper surface of the partition and the surface of the opposed substrate. In this state of the PDP, the substrate is vibrated locally by periodical electrostatic attraction due to an application of a high frequency drive voltage for a display. Thus, minute acoustic noise is generated. This noise drops a quality of the display operation.

SUMMARY OF THE INVENTION

An object of the present invention is to prevent an operational quality from being deteriorated by resonance of a substrate.

According to one aspect of the present invention, the vibrating portion of a substrate that constitutes a plasma display panel is made to have a natural frequency higher than audio frequency region of a human, so that a user cannot hear the acoustic noise. Supposing that the audio frequency region of a human is 20–20000 hertz, it is the best to make the natural frequency higher than 20000 hertz. However, in the range above 16000 hertz, a sound is hard to hear unless its sound pressure is sufficiently large. Therefore, if the natural frequency is raised above 16000 hertz, the user cannot hear the acoustic noise substantially. Raising the natural frequency above 16000 hertz is useful as a practical method.

The natural frequency is determined by a length of the vibrating portion of the substrate, a thickness of the substrate, a density of the substrate and a Young's modulus of the substrate. The natural frequency can be raised by shortening the vibrating portion. In addition, the natural frequency can be raised by any method of enlarging the thickness of the substrate, using a substrate having a small density, or using a substrate having a large Young's modulus.

DESCRIPTION OF THE PREFERRED EMBODIMENTS

Hereinafter, the present invention will be explained more in detail with reference to embodiments and drawings.

Figure 1A:
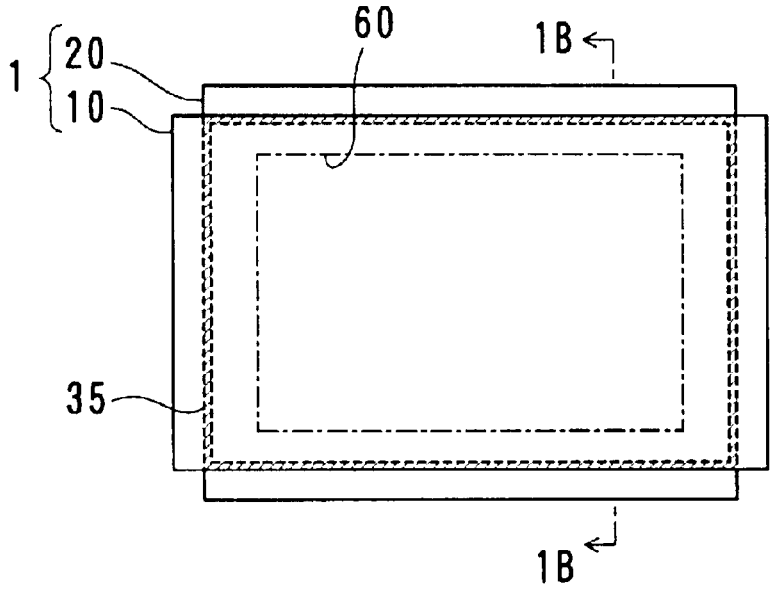
FIGS. 1A and 1B show a general structure of a PDP according to the present invention.
Figure 1B:
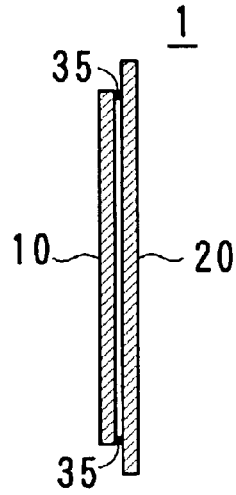

FIGS. 1A and 1B show a general structure of a PDP according to the present invention. FIG. 1A is a plan view, and FIG. 1B is a cross section of FIG. 1A along 1B—1B line. A PDP 1 comprises a pair of substrate structural bodies 10 and 20. The substrate structural body means a plate-like structural body including a substrate having a size larger than a display screen 60 and at least one other element constituting a panel. The substrate structural bodies 10 and 20 are made independently of each other and are placed so as to oppose and overlap each other. The peripheral portions of the opposed area are sealed with a sealing material 35 to be a unit. The gap between the opposed substrate structural bodies 10 and 20 sealed with the sealing material 35 makes a discharge gas space. The substrate structural body 10 has a dimension protruding from both sides of the substrate structural body 20 in the horizontal direction, while the substrate structural body 20 has a dimension protruding from both sides of the substrate structural body 10 in the vertical direction. On these protruding portions, electrode terminals drawn out of the display screen 60 are arranged for being connected to a driving circuit. The display screen 60 has a dimension that the peripheral portion thereof is apart from the sealing material 35 by approximately 15 millimeters.

Figure 2:
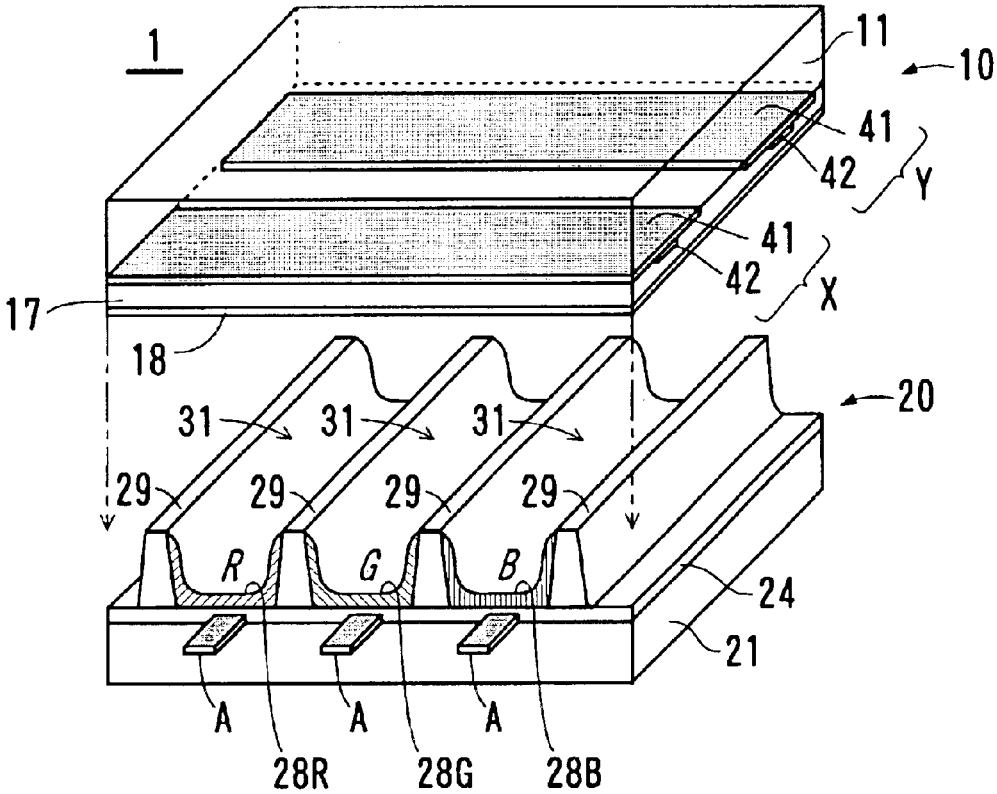
FIG. 2 is a diagram showing an example of a cell structure of a PDP.

FIG. 2 is a diagram showing an example of a cell structure of a PDP. In FIG. 2, the portion including three cells of the PDP 1 corresponding to one pixel display is shown apart from a pair of substrate structural bodies so that the inner structure can be seen easily.

In each of the cells constituting the display screen, display electrodes X and Y and address electrodes A cross each other. The display electrodes X and Y are arranged on the inner surface of the front glass substrate (the front substrate) 11. Each of the display electrodes X and Y includes a transparent conductive film 41 that forms a surface discharge gap and a metal film (a bus electrode) 42 that extends over the entire length of the row. The display electrode pairs are covered with a dielectric layer 17 having the thickness of approximately 30–50 microns, and the surface of the dielectric layer 17 is coated with a protection film 18 that is made of magnesia (MgO). The address electrodes A are arranged on the inner surface of the back glass substrate 21 and are covered with a dielectric layer 24. On the dielectric layer 24, band-like partitions 29 having the height of approximately 140 microns and being made of a low melting point glass are arranged so that one partition 29 is positioned between address electrodes A. These partitions 29 divide the discharge gas space into columns in the direction along the row of the matrix display and define the size of the discharge gas space in the front and back direction. Each of column spaces 31 of the discharge gas space corresponds to each column and is continuous over all rows. The inner surface of the back side including upper surfaces of the address electrodes A and side faces of the partitions 29 is covered with fluorescent material layers 28R, 28G and 28B of red, green and blue colors for a color display. Italic letters R, G and B in FIG. 2 represent light emission colors of the fluorescent materials. The fluorescent material layers 28R, 28G and 28B are excited locally by ultraviolet rays emitted by the discharge gas and emit light.

Figure 3:
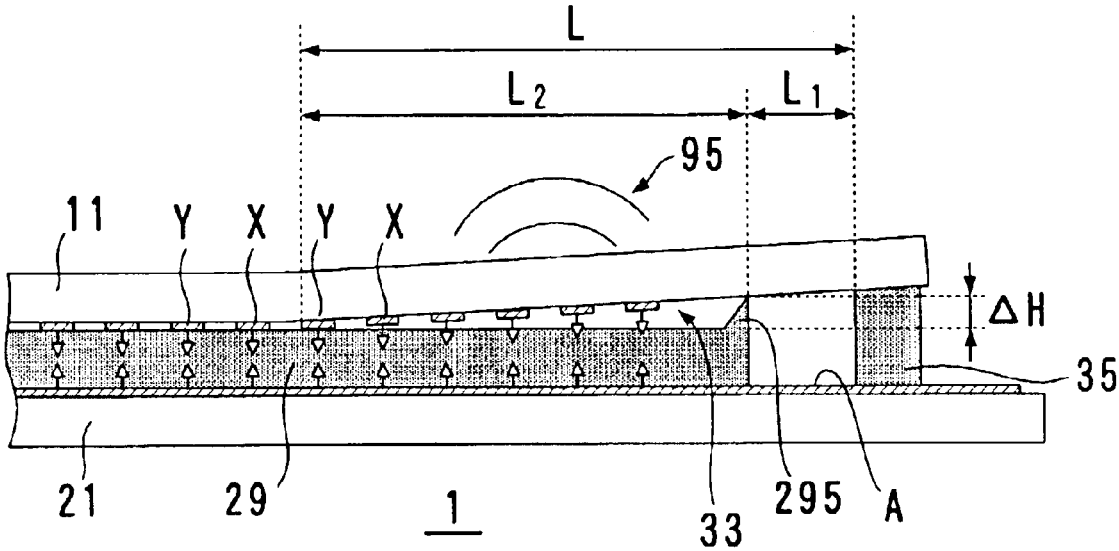
FIG. 3 is a schematic diagram of a structure of a main portion of the PDP.

FIG. 3 is a schematic diagram of a structure of a main portion of the PDP. In FIG. 3, elements of the front substrate structural body except the glass substrate 11 are omitted, and elements of the back substrate structural body except the glass substrate 21 and the partition 29 are omitted. Actually, the thickness of the glass substrates 11 and 21 is 2–3 millimeters, while the thickness of the dielectric layer is approximately 30 microns that is sufficiently small. In addition, the electrodes and the protection film are thinner than the dielectric layer.

In the PDP 1, the partitions 29 are formed on the back glass substrate 21 as mentioned above, and the end portion thereof is raised to be higher than other portions. The height ΔH of the raised portion 295 at the end portion of the partition is approximately 30 microns. The sealing material 35 is made of a low melting point glass that has a softening point lower than the partition material. Therefore, in the sealing process for glass-fusing the glass substrate 11 and the glass substrate 21, the partition 29 is not softened. As a result, the end portion of the glass substrate 11 is deformed to curve slightly in the sealing process, so that a void space 33 having the length $L_2$ is formed between the glass substrate 11 (strictly the dielectric layer 17) and the upper surface of the partition 29. A so-called floating structure in which the glass substrate 11 is supported unstably (this portion of the structure is called a "beam") is formed over the range of the length L from the inner edge of the void space 33 to the inner edge of the sealing material 35 that is the fixed edge. In the PDP 1 having the above-mentioned beam, a buzz sound 95 is generated during a display operation. Namely, when applying a high frequency drive voltage to cells, a periodical electrostatic attraction force works between the display electrode X or Y and the address electrode A that are opposed to each other via the discharge gas space. Thus, the beam portion of the glass substrate 11 is vibrated uniquely by absorbing a vibration energy corresponding to the resonance frequency thereof. According to the present invention, the natural frequency of the beam is higher than the audio frequency region of a human, so that a user of the PDP 1 cannot hear the buzz sound. In other words, the buzz sound 95 is eliminated in an artificial manner.

The natural frequency F of the beam illustrated in FIG. 3 is expressed in the following equality.

$$F = \frac{a_n}{2\pi L^2} \cdot \sqrt{\frac{Eh^2}{12\rho}} \tag{1}$$

Here, $a_n$ is a constant (=22) in the case of the fixed edge, L is the distance from the inner edge of the void space to the sealing material, E is a Young's modulus of the front substrate, h is the thickness of the front substrate, and ρ is a density of the front substrate.

Figure 4:
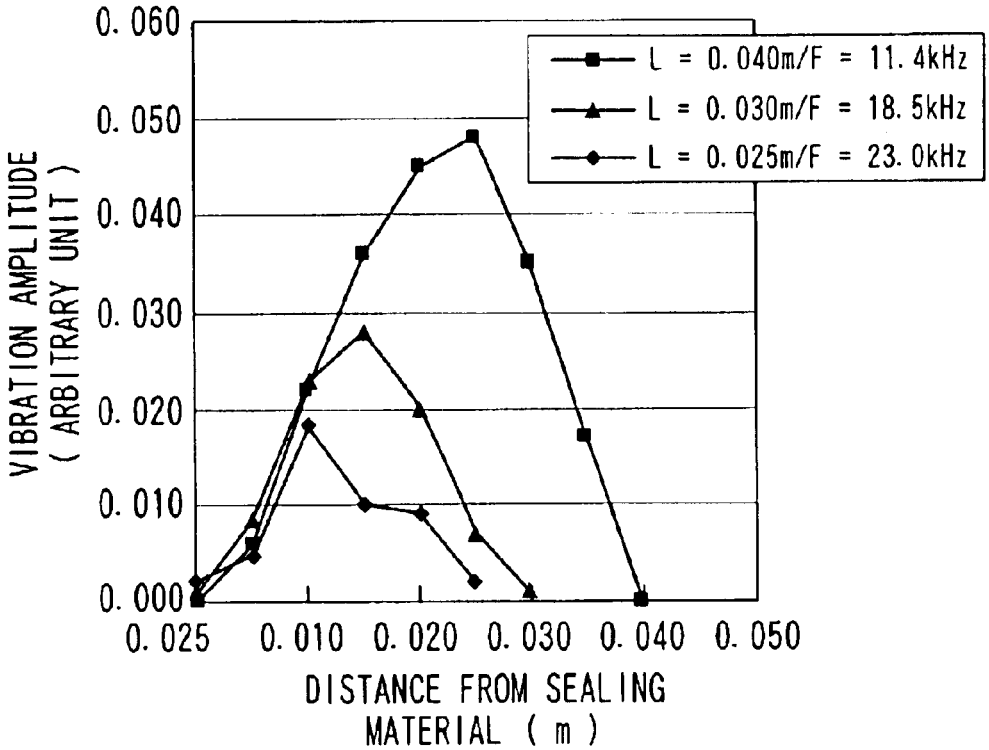
FIG. 4 is a diagram showing the relationship between the length of a beam and vibration amplitude.

Since the natural frequency F is inversely proportional to the square of L as shown in the equality (1), the natural frequency F becomes higher as the length L of the beam becomes shorter. Furthermore, as shown in FIG. 4, the amplitude of the natural vibration (i.e., the sound pressure of the buzz sound) becomes smaller as the length L of the beam becomes shorter. Therefore, the problem of the buzz sound is solved by shortening the length L of the beam. However, the length $L_2$ of the void space 33 shown in FIG. 3 is dependent on the raise quantity of the partition 29 and the pressure of the filled discharge gas, so it is not easy to shorten the length $L_2$. On the other hand, the length $L_1$ from the end of the partition 29 (i.e., the raised portion 295) to the sealing material 35 can be shortened relatively easily by redesigning the dimension, which is a realistic method for shortening the beam.

FIRST EXAMPLE

Figure 5:
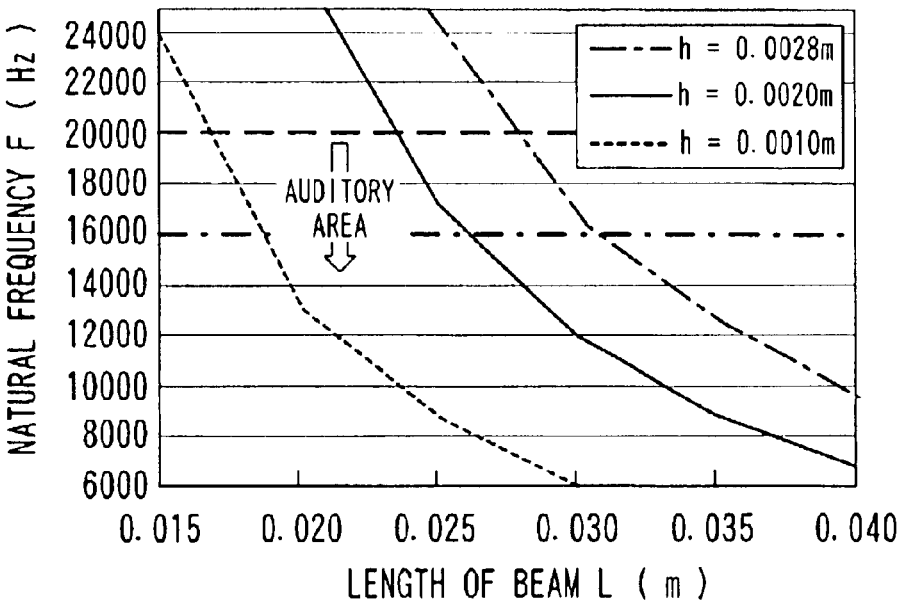
FIG. 5 is a diagram showing resonance characteristics of a glass substrate having a high distortion point.
Figure 6:
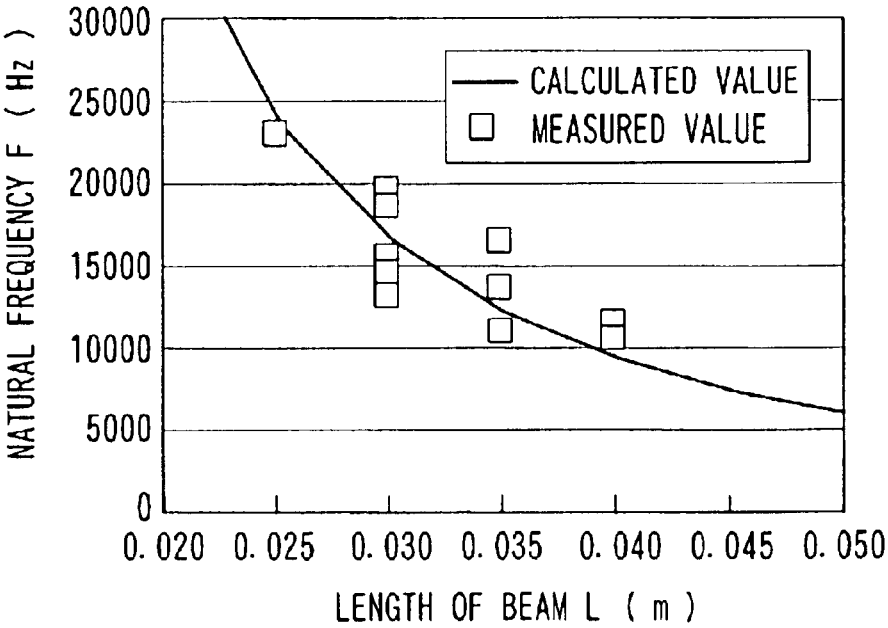
FIG. 6 is a diagram showing resonance characteristics of a glass substrate having a high distortion point and h=0.0028 meter.

In the PDP having the front substrate 11 made of a high distortion point glass having E=78 GPa and ρ=2770 kg/m$^3$, the relationship between the length L of the beam and the natural frequency F is as shown in FIGS. 5 and 6. As shown in FIG. 6, the measured value of the natural frequency F when h=0.0028 meters is substantially identical to the calculated value.

In the case where the length $L_2$ of the void space 33 is 0.01 meters, in order to raise the natural frequency F above the upper limit value 20000 Hz of the audio frequency region, the length $L_1$ is set to the value that satisfies the conditions below.

When a substrate having h=0.0028 meters is used, $L_1$ is less than 0.017 meters.

When a substrate having h=0.0020 meters is used, $L_1$ is less than 0.013 meters.

When a substrate having h=0.0010 meters is used, $L_1$ is less than 0.006 meters.

SECOND EXAMPLE

Figure 7:
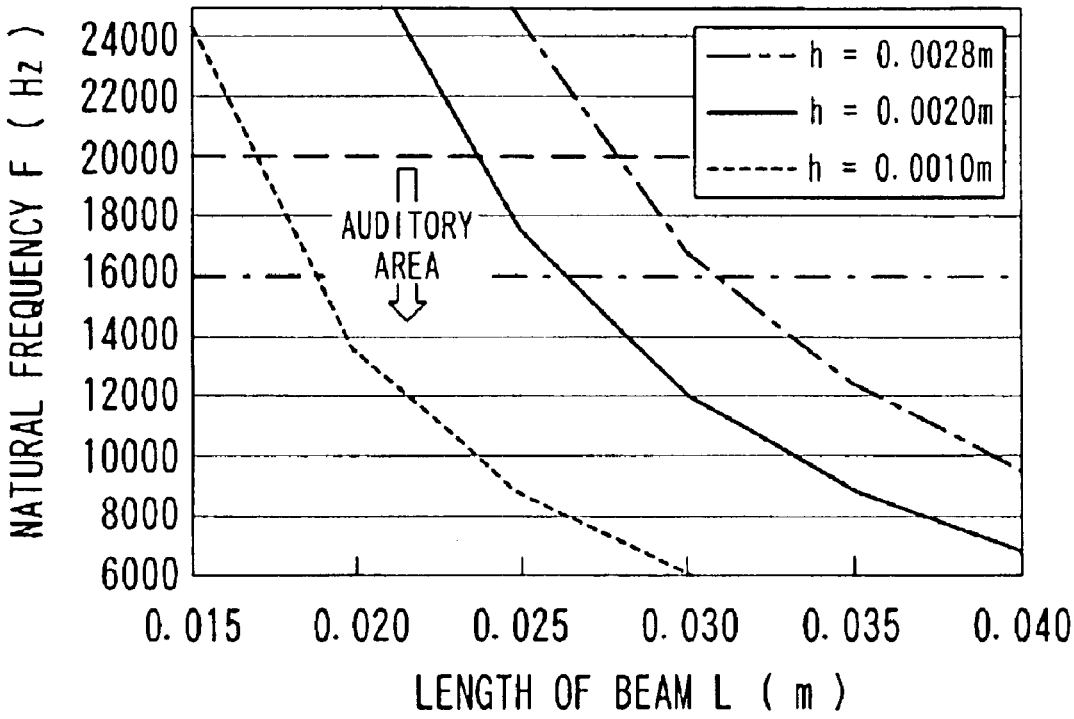
FIG. 7 is a diagram showing resonance characteristics of a soda glass substrate.

In the PDP having the front substrate 11 made of a soda glass having E=73 GPa and ρ=2500 kg/M$^3$, the relationship between the length L of the beam and the natural frequency F is as shown in FIG. 7. In the case where the length $L_2$ of the void space 33 is 0.01 meters, in order to raise the natural frequency F above the upper limit value 20000 Hz of the audio frequency region, the length $L_1$ is set to the value that satisfies the conditions below.

When a substrate having h=0.0028 meters is used, $L_1$ is less than 0.018 meters.

When a substrate having h=0.0020 meters is used, $L_1$ is less than 0.013 meters.

When a substrate having h=0.0010 meters is used, $L_1$ is less than 0.007 meters.

As explained above, by shortening the length L of the beam, the natural frequency F of the beam is raised above the audio frequency region. However, without being limited to this method, any other method such as thickening the substrate, using a substrate having a small density, or using a substrate having a large Young's modulus can be adopted so as to raise the natural frequency F. In other words, it is sufficient that the thickness h of the front substrate 11 satisfies the inequality (2) or that the density ρ satisfies the inequality (3) or that the Young's modulus E satisfies the inequality (4).

$$h > \frac{2\pi L^2 f_{\max}}{a_n} \cdot \sqrt{\frac{12\rho}{E}} \tag{2}$$

Here, h is the thickness of the front substrate, L is the distance from the inner edge of the void space to the sealing material, an is a constant (=22), $f_{max}$ is the upper limit value of the audio frequency region of a human, ρ is a density of the front substrate, and E is a Young's modulus of the front substrate.

$$\rho < \frac{E}{12} \cdot \left(\frac{a_n h}{2\pi L^2 f_{\max}}\right)^2 \tag{3}$$

Here, ρ is a density of the front substrate, E is a Young's modulus of the front substrate, $a_n$ is a constant (=22), h is the thickness of the front substrate, L is the distance from the inner edge of the void space to the sealing material, and $f_{max}$ is the upper limit value of the audio frequency region of a human.

$$E > 12\rho \cdot \left(\frac{2\pi L^2 f_{\max}}{a_n h}\right)^2 \tag{4}$$

Here, E is a Young's modulus of the front substrate, ρ is a density of the front substrate, L is the distance from the inner edge of the void space to the sealing material, $f_{max}$ is the upper limit value of the audio frequency region of a human, $a_n$ is a constant (=22), and h is the thickness of the front substrate.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A plasma display panel comprising:

a first and a second substrates opposed to each other and sealed at a peripheral portion of the opposed area with a sealing material so as to define a discharge gas space;

a partition attached to the second substrate for dividing the discharge gas space in accordance with a cell arrangement of a display screen;

a gap between the substrates, the size of the gap being dependent on the height of the partition that is apart from the sealing material;

a plurality of electrodes arranged on both the first and the second substrates; and a void space between the upper surface of the partition and the opposed surface to be contacted at the vicinity of an end portion of the partition, the void space being generated when the end portion of the partition is raised, wherein a natural frequency of a portion of the first substrate from an inner edge of the void space to an inner edge of the sealing material is higher than 20.000 hertz.

2. A plasma display panel comprising:

a first and a second substrates opposed to each other and sealed at a peripheral portion of the opposed area with a sealing material so as to define a discharge gas space;

a partition attached to the second substrate for dividing the discharge gas space in accordance with a cell arrangement of a display screen;

a gap between the substrates, the size of the gap being dependent on the height of the partition that is apart from the sealing material;

a plurality of electrodes arranged on both the first and the second substrates; and a void space between the upper surface of the partition and the opposed surface to be contacted at the vicinity of an end portion of the partition, the void space being generated when the end portion of the partition is raised, wherein a natural frequency of a portion of the first substrate from an inner edge of the void space to an inner edge of the sealing material is higher than 16000 hertz.

3. The plasma display panel according to claim 1, wherein a distance L from the inner edge of the void space to the sealing material satisfies the following inequality:

$$L < \sqrt{\frac{a_n}{2\pi f_{\max}} \cdot \sqrt{\frac{Eh^2}{12\rho}}}$$

where L is the distance from the inner edge of the void space to the sealing material, $a_n$ is a constant (=22), $f_{max}$ is a frequency of 20,000 hertz, E is a Young's modulus of the first substrate, h is a thickness of the first substrate, and ρ is a density of the first substrate.

4. The plasma display panel according to claim 1, wherein a thickness h of the first substrate satisfies the following inequality:

$$h > \frac{2\pi L^2 f_{\max}}{a_n} \cdot \sqrt{\frac{12\rho}{E}}$$

where h is the thickness of the first substrate, L is a distance from the inner edge of the void space to the sealing material, $a_n$ is a constant (=22), $f_{max}$ is a frequency of 20,000 hertz, ρ is a density of the first substrate, and E is a Young's modulus of the first substrate.

5. The plasma display panel according to claim 1, wherein a density ρ of the first substrate satisfies the following inequality:

$$\rho < \frac{E}{12} \cdot \left( \frac{a_n h}{2\pi L^2 f_{\max}} \right)^2$$

where ρ is the density of the first substrate, E is a Young's modulus of the first substrate, $a_n$ is a constant (=22), h is a thickness of the first substrate, L is a distance from the inner edge of the void space to the sealing material, and $f_{max}$ is a frequency of 20,000 hertz.

6. The plasma display panel according to claim 1, wherein a Young's modulus E of the first substrate satisfies the following inequality:

$$E > 12\rho \cdot \left( \frac{2\pi L^2 f_{\max}}{a_n h} \right)^2$$

where E is the Young's modulus of the first substrate, ρ is a density of the first substrate, L is a distance from the inner edge of the void space to the sealing material, fmax is a frequency of 20,000 hertz, an is a constant (=22), and h is a thickness of the first substrate.

7. The plasma display panel according to claim 2, wherein a distance L from the inner edge of the void space to the sealing material satisfies the following inequality:

$$L < \sqrt{\frac{a_n}{2\pi f_{\max}} \cdot \sqrt{\frac{Eh^2}{12\rho}}}$$

where L is the distance from the inner edge of the void space to the sealing material, $a_n$ is a constant (=22), $f_{max}$ is a frequency of 16,000 hertz, E is a Young's modulus of the first substrate, h is a thickness of the first substrate, and ρ is a density of the first substrate.

8. The plasma display panel according to claim 2, wherein a thickness h of the first substrate satisfies the following inequality:

$$h > \frac{2\pi L^2 f_{\max}}{a_n} \cdot \sqrt{\frac{12\rho}{E}}$$

where h is the thickness of the first substrate, L is a distance from the inner edge of the void space to the sealing material, $a_n$ is a constant (=22), $f_{max}$ is a frequency of 16,000 hertz, ρ is a density of the first substrate, and E is a Young's modulus of the first substrate.

9. The plasma display panel according to claim 2, wherein a density ρ of the first substrate satisfies the following inequality:

$$\rho < \frac{E}{12} \cdot \left( \frac{a_n h}{2\pi L^2 f_{\max}} \right)^2$$

where ρ is the density of the first substrate, E is a Young's modulus of the first substrate, $a_n$ is a constant (=22), h is a thickness of the first substrate, L is a distance from the inner edge of the void space to the sealing material, and $f_{max}$ is a frequency of 16,000 hertz.

10. The plasma display panel according to claim 2, wherein a Young's modulus E of the first substrate satisfies the following inequality:

$$E > 12\rho \cdot \left( \frac{2\pi L^2 f_{\max}}{a_n h} \right)^2$$

where E is the Young's modulus of the first substrate, ρ is a density of the first substrate, L is a distance from the inner edge of the void space to the sealing material, fmax is a frequency of 16,000 hertz, $a_n$ is a constant (=22), and h is a thickness of the first substrate.

* * * * *

UNITED STATES PATENT AND TRADEMARK OFFICE

CERTIFICATE OF CORRECTION

PATENT NO. : 6,924,597 B2
APPLICATION NO. : 10/370524
DATED : August 2, 2005
INVENTOR(S) : Kenji Yoshida et al.

It is certified that error appears in the above-identified patent and that said Letters Patent is hereby corrected as shown below:

Column 6, line 17 (approx.) change “20.000” to --20,000--.

Column 7, line 26 (approx.), change “fmax” to --$f_{max}$--;

Column 7, line 26 (approx.), change “an” to --$a_n$--.

Column 8, line 39 (approx.), change “fmax” to --$f_{max}$--.

Signed and Sealed this

First Day of August, 2006

JON W. DUDAS
*Director of the United States Patent and Trademark Office*